US005269455A

United States Patent [19]

Grigsby et al.

[11] Patent Number: 5,269,455

[45] Date of Patent: Dec. 14, 1993

[54] SOCKET

[75] Inventors: Charles F. Grigsby; John M. Grigsby, both of Marietta, Ga.

[73] Assignee: North American Container Corporation, Mableton, Ga.

[21] Appl. No.: 880,193

[22] Filed: May 8, 1992

[51] Int. Cl.[5] ..... B65D 19/20; B65D 19/38

[52] U.S. Cl. ..... 229/23 C; 206/386; 217/43 A

[58] Field of Search ..... 206/386; 229/23 C, 918, 229/DIG. 11; 217/43 A, 65

[56] References Cited

U.S. PATENT DOCUMENTS

| | | | |
|---|---|---|---|
| 2,471,693 | 5/1949 | Lilienfeld | 217/43 A |
| 2,895,186 | 7/1959 | Franks | 217/43 A |
| 2,965,276 | 12/1960 | Foster . | |
| 3,136,472 | 6/1964 | Waller et al. | 229/23 C |
| 3,262,597 | 7/1966 | Coffey, Jr. | 217/43 A |
| 3,944,073 | 3/1976 | Downing | 217/65 |
| 4,799,620 | 1/1989 | Vilella | 229/918 |
| 4,852,756 | 8/1989 | Holladay | 229/23 C |
| 5,036,979 | 8/1991 | Selz | 206/386 |
| 5,069,338 | 12/1991 | Grigsby . | |
| 5,096,112 | 3/1992 | Grigsby . | |

FOREIGN PATENT DOCUMENTS

| | | | |
|---|---|---|---|
| 23559 | 6/1936 | Australia | 217/65 |
| 562730 | 9/1958 | Canada | 229/23 C |
| 195332 | 5/1957 | Fed. Rep. of Germany | 217/43 A |
| 1282830 | 12/1961 | France | 217/43 A |
| 1528914 | 5/1968 | France | 217/43 A |
| 83681 | 1/1920 | Switzerland . | |

*Primary Examiner*—Gary E. Elkins
*Attorney, Agent, or Firm*—Kennedy & Kennedy

[57] ABSTRACT

An integral socket attached to a base for receiving an end of a vertical cleat in a corrugated paperboard container, the socket having a bottom skirt for aligning the socket to a side face of a member of the base and a top skirt for restraining the vertical cleat from moving out of the socket. A cavity defined in the socket receives therein a tenon at the end of the vertical cleat.

8 Claims, 1 Drawing Sheet

SOCKET

TECHNICAL FIELD

This invention relates generally to a corrugated paperboard container reinforced with vertical cleats. More particularly, this invention relates to a socket that receives an end of a vertical reinforcement cleat of a corrugated paperboard container.

BACKGROUND OF THE INVENTION

Wood-cleated boxes have long been used to package heavy equipment such as lawn and garden tractors, lawn mowers, snowmobiles, engines, air conditioners, and the like. The conventional wood-cleated box consists of a wood reinforced corrugated paperboard body, a wooden top frame and a wooden base. Typically, the corrugated paperboard body is rectangular with opposing end walls and opposing side walls. At least one interior surface of a wall of the currugated body is provided with a reinforcement cleat vertically aligned and attached thereto to provide stacking strength for the container. The reinforcement is typically made of a hard wood or wood-like material. The corrugated paperboard body gives the container definition and maintains the position of the vertical wood reinforcement cleats. The base member, often referred to as a skid or pallet, supports the container and the product packed therein. The top frame can be considered to be a base for closing off the container, and the top frame further provides a constant surface upon which another container may be stacked. The top frame aids in distributing a top load imposed on the container; for example, a top load is imposed by a smaller package placed on top of the container in a less-than-load shipment. The arrangement of the wood-cleated box seeks to prevent collapse of the corrugated body when handled or shipped, even in multi-unit stacks, typically having between two and six units. Such wood-cleated boxes with mating bases and top frames provide stacking strength for packing, storing, and shipping heavy articles.

The end walls of the corrugated body typically are each provided with a pair of the vertical reinforcement cleats. The cleats attach to the wall near the corners defined by the end wall and a side wall of the corrugated body. The bottom end of the vertical reinforcement cleats are finished with a notch or bevel which matingly engages a notch or bevel on the base to interlock the container and the base. Similarly, the upper end of the vertical reinforcement cleats also defines a notch or bevel for engaging a mating notch or bevel in the top frame. The top frame, the vertical cleats, and the base are thereby interlocked together. Loads on the container are transmitted by the vertical cleats to the top frame and the base.

Each of the side walls of the corrugated body can also be provided with a vertical reinforcement cleat that attach in the center between the end walls. Such center cleats provide further support for the top frame and a top load imposed by other containers stacked thereon. The vertical reinforcement cleats for the side walls are typically made of a hard, dense wood or similar material. Often the lower and the upper ends of the center cleats are finished for engaging the cleat with the base and the top frame, respectively. For instance, the lower end of the cleat is cut to define a tenon which is received in a mortise on the base. The upper end of the cleat can be notched or beveled to matingly engage a notch or bevel on the top frame.

The wood-cleated boxes discussed above are particularly suited for handling by clamp truck, because the notches, the bevels, and the mortise/tenon connections generally restrain the vertical reinforcement cleats from moving laterally out of connection with the base or top frame during handling. The clamp truck (sometimes called a squeeze truck) uses hydraulically operated platens which exert pressure of sufficient force on the sides of the container to allow the container to be lifted by the truck for moving and stacking in a warehouse for storage or in a trailer for shipment. Clamp handling equipment is often preferred over forklift trucks as the box then does not require external skid boards such as are used with a box adapted for fork-lift handling.

The pressure of the horizontal force applied by the platens to the wood-cleated box, however, may break or otherwise separate the vertical cleat from the base or the top frame. For instance, the notches and bevels are typically cut to a depth between about one-third and one-half or more of the thickness of the wood member of the base or the top frame. Such cuts lead to structural weakening of the member. Excessive horizontal force on the cleat may break the notch at the narrow portion or move the cleat inwardly from the side of the container and out of engagement with the base or the top frame. Such a damaged support cleat may cause the container to collapse, particularly if other containers are stacked thereon. Collapse or damage to the container may lead to damage to the article packaged therein. Also, the manufacture of the members of the base (and top frame) with the notches and bevels is time consuming and labor intensive. Special machinery may be required to cut the features in the members. Assembly of the base and the top frame is labor intensive to align and attach the members together. Should the wood pieces be mis-cut or mis-assembled, the base and top frame would be improperly formed for receiving the end of the vertical cleat attached to the corrugated body. Also, the members of the base or top frame may not be properly assembled or mis-aligned, so that the notch or bevel in the member is incapable of receiving and holding the vertical cleat.

Thus, there is a need in the art for a socket that readily and easily attaches to a base or top frame for receiving an end of a vertical reinforcement cleat attached to a wall of a corrugated paperboard body.

SUMMARY OF THE INVENTION

The present invention solves the above-described problems with engaging vertical reinforcement cleats of a corrugated body with a base and top frame by providing a molded corner socket and a molded center socket that readily seat on a square-cut face of a member of the base or top frame for receiving an end of a vertical cleat attached to the corrugated paperboard body.

Generally described, the present invention provides an integral molded socket having a depending bottom skirt for aligning the socket with a side of a member of the base or top frame. A top plate of the socket receives one of the ends of the vertical cleat and a top skirt that extends upwardly from the top plate restrains the vertical cleat from moving out of the socket.

More particularly described, the socket for the corner cleat provides a top plate disposed at an angle that slopes downwardly from an outside edge to an inside edge at the side of the top skirt. A plurality of flanges extend from a back side of the top skirt to provide lateral support to the top skirt for resisting movement of the vertical cleat out of the socket when the corrugated paperboard body is shipped, stored, and handled.

In an alternate embodiment, the top plate defines a cavity therein for receiving a mating end of the vertical cleat. More particularly described, the socket defines a mortise and the end of the cleat defines a tenon which is received therein. The cavity in the top plate prevents the vertical cleat from movement off of the socket during shipping and handling of the container, particularly with clamp trucks.

Thus, it is an object of the present invention to provide a socket that attaches to a base for receiving a vertical cleat of a corrugated body.

It is a further object of the present invention to provide a socket that is pre-formed for attaching to a base for a wood-cleated box.

It is a further object of the present invention to provide a socket that easily attaches to a base.

It is a further object of the present invention to provide a socket that is uniformly manufactured.

It is a further object of the present invention to provide a socket that provides a wood-cleated box with increased lateral and longitudinal compression strength.

It is a further object of the present invention to provide a socket that restrains a vertical cleat attached to a corrugated body from moving out of alignment with a base during handling and shipping.

These and other objects, features and advantages will become apparent from a reading of the following detailed description of the invention and claims in view of the appended drawings.

DETAILED DESCRIPTION OF THE PREFERRED EMBODIMENTS

Figure 1:
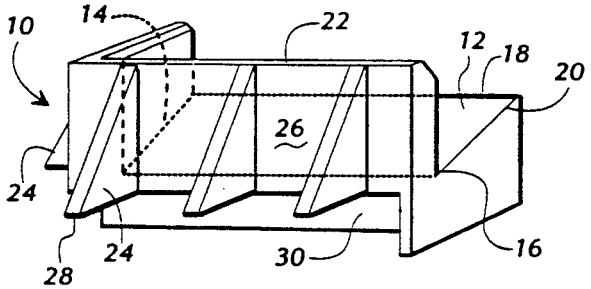
FIG. 1 is a perspective view of a preferred embodiment of a corner socket constructed in accordance with the present invention.

Referring now in more detail to the drawings in which like numerals indicate like parts throughout the several views, FIG. 1 shows a perspective view of a corner socket 10 that attaches to a member of a base (and top frame as discussed below) for receiving an end of a vertical cleat of a reinforced corrugated container. The corner socket 10 is an integral body having a top plate 12 on which the end of the vertical cleat rests, as discussed below. The top plate 12 defines an inside end edge 14, an inside side 16, an outside side edge 18, and an outside end edge 20. The terms "inside" and "outside" are relative to the placement of the corner socket 10 on a side of a base for a wood-cleated box, as discussed below. Inside refers to the interior of the box; outside refers to the exterior. The top plate 12 slopes downwardly from the outside edge 18 to the inside edge 16 to define a bevel surface for receiving thereon an end of a vertical cleat. The slope is preferably about 24 degrees.

A top skirt 22 extends upwardly as a wall along the inside edges 14 and 16 of the corner socket. The top skirt 22 prevents the end of the vertical cleat from moving off of the top plate 12 when clamp truck pressure is applied against the sides of the container. The corner socket 10 preferably conforms in shape and size to the cross-section of the vertical cleat received thereon, so that the vertical cleat preferably fits with close tolerances in the corner socket, as discussed below. In the illustrated embodiment having a rectangular corner socket 10, the top skirt 22 defines an L-shaped wall in top view.

The corner socket 10 further includes a plurality of flanges 24 that extend outwardly as ribs from a back side 26 of the top skirt 22. The flanges 24 are preferably wedge shaped, with a wide base 28 at a bottom portion of the top skirt 22. The flanges 24 are spaced-apart and provide lateral support to the top skirt 22 when the container is handled by a clamp truck, as discussed above.

A bottom skirt 30 extends downwardly from the top plate 12 along the outside edges 18 and 20, and the bottom skirt 30 preferably defines an L-shaped wall, in bottom view. As discussed below, the bottom skirt 30 abuts the side faces of the member of the base to which the socket 10 is attached. The bottom skirt 30 is a locator tab that enables the socket 10 to be easily and quickly positioned on the member during assembly of the base.

Figure 2:
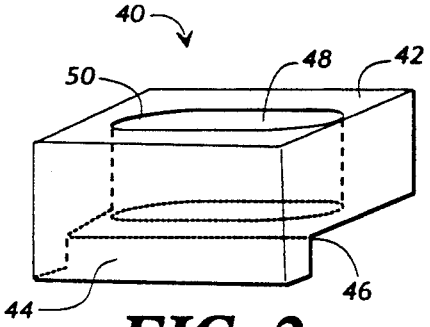
FIG. 2 is a perspective view of a preferred embodiment of a center socket constructed in accordance with the present invention.

FIG. 2 is a perspective view of a center socket 40 that attaches to a member of a base for receiving an end of a vertical cleat of a reinforced corrugated container. The center socket 40 is an integral body having a top plate 42 from which a side skirt 44 extends downwardly from an outside edge 46 of the top plate 42. In the illustrated embodiment, the top plate 42 is horizontal. As discussed below, the side skirt 44 abuts a side face of a member of the base to which the center socket 40 is attached. The side skirt 44 facilitates easy and rapid placement of the center socket 40 on the member.

The top plate 42 further defines a cavity 48 disposed centrally in the top plate 42. The cavity 48 receives an end of the vertical cleat attached to a side panel of a corrugated body and restrains the cleat from being moved off of the socket 40. In the illustrated embodiment, the cavity 48 is an elongate slot with rounded ends 50 for receiving therein a tenon cut on the end of a vertical cleat, as discussed below. The cavity 48 in the illustrated embodiment extends through the top plate 42. In an alternate embodiment (not illustrated), the cavity 48 has a closed bottom. The cavity 48 preferably conforms in cross-sectional shape and size to the tenon on the vertical cleat in order to hold the cleat firmly in place in the socket.

Figure 3:
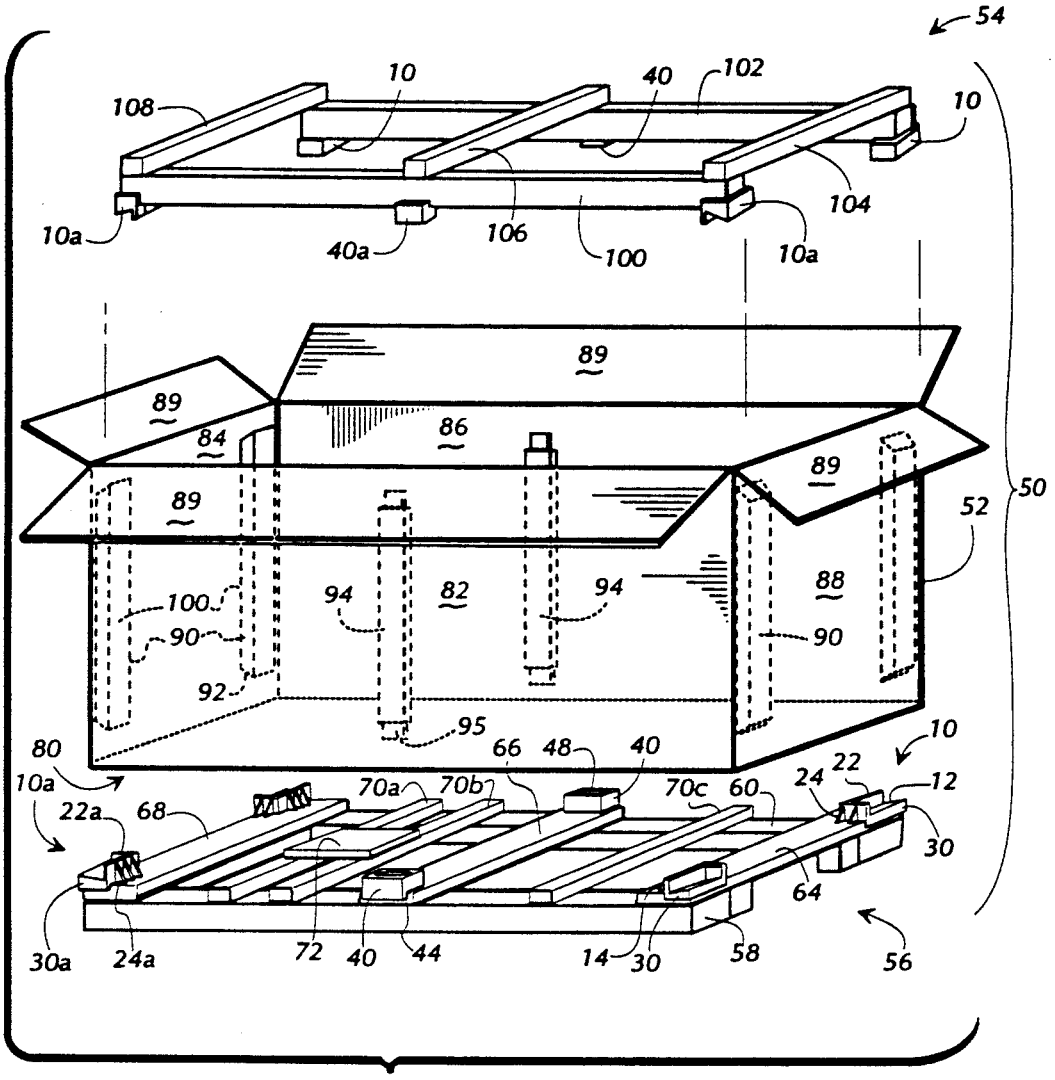
FIG. 3 is a perspective view of a base and top frame having corner sockets and center sockets illustrated in FIGS. 1 and 2, exploded from a corrugated paperboard body having vertical cleats for receiving by the sockets.

FIG. 3 illustrates the practice of the sockets of the present invention in a wood-cleated box 50 comprising a wood reinforced corrugated paperboard body 52, a wooden top frame 54 and a wooden base 56 that receives the open bottom of the corrugated body 52. The top frame 54 inserts into the open top of the corrugated body 52 to provide top load strength and to close the corrugated body.

The base 56 is a rigid pallet adapted to hold articles to be packaged, stored and shipped in the wood-cleated box 50. In the embodiment illustrated in FIG. 3, the base 56 consists of a pair of runners 58 and 60 which are spaced apart and parallel. The distance between the outside runners 58 and 62 conforms to the width of the corrugated body 52. As illustrated, it is preferred that the runners 58 and 60 extend parallel to the longitudinal axis of the corrugated body 52. The runners 58 and 60 are rigidly connected to three main cross boards 64, 66 and 68, each preferably having square-cut longitudinal ends. The cross boards 64 and 68 are disposed at the respective longitudinal ends of the runners 58 and 60, and the cross board 66 is disposed medial the longitudinal ends of the runners. Other cross members and frame members can be attached to the base 56 to support a variety of articles on the base. For instance, in the illustrated embodiment, the base 56 includes three additional cross members 70 that are disposed normal to the runners 58, 60 and 62. Two of the cross members 70*a* and 70*b* are disposed and spaced apart between the cross member 68 and the cross member 66. The spaced-apart cross members 70*a* and 70*b* are joined together by a cleat 72 disposed parallel to the runners 58 and 60 and are rigidly connected to the cross members 70*a* and 70*b*. The third cross member 70*c* is disposed between the cross member 66 and the cross member 64. The cross members 70 are rigidly connected to the runners 58, 60 and 62 to provide additional strength for the base 56 and to support an article thereon for enclosing in the corrugated body 52.

The corner socket 10 (illustrated in FIG. 1) mounts to an upper surface of the cross member 64 and the cross member 68 at the longitudinal ends thereof. The L-shaped bottom skirt 30 abuts against the perpendicular side faces of the cross member 64 in order to position the corner socket 10 on the outside corner of the cross member 64. The bottom skirt 30 accordingly is a locator tab for easily and quickly positioning the corner socket 10 on the cross members 64 and 68. The corner socket 10 is rigidly connected to the cross member 64 by driving a plurality of staples, nails or the like through the top plate 12 and into the cross member 64. Such securing devices could also be driven through the skirt 30 into the thickness of the cross members 64 and 68. The bottom edge 28 of the wedge-like flanges 26 rests on the upper surface of the cross member 64 and 68 to provide lateral support to the upward extending skirt 22 during handling and shipping of the container. It is to be appreciated that the corner socket 10 shown in FIG. 1 is adapted for fitting the right side of a cross members 64 and 68. A mirror image corner socket 10*a* is adapted for fitting on the left longitudinal end of the cross members 64 and 68. The bottom skirt 30 abuts the perpendicular side faces of the cross members 64 and 68 to quickly position the corner sockets 10 thereon.

A pair of the center sockets 40 attach to the edges of the center cross member 66. The depending skirt 44 of each center socket 40 abuts against a respective right or left side face of the cross member 66. A plurality of staples are driven through the top plate 42 of each of the center sockets 40 to rigidly connect the center sockets 40 to the cross member 66. The staples could also be driven through the skirt 44 into the thickness of the cross member 66.

The depending skirts 20 and 44 on the corner socket 10 and the center socket 40, respectively, facilitate rapid and easy positioning of the corner sockets and the center sockets on the cross member 64, 66 and 68 during assembly. The corner sockets 10 and the center socket 40 preferably are molded of a relatively hard plastic material to withstand shock and to provide strength and rigidity to the framing of the wood-cleated box 50. The corner socket 10 and the center socket 40 could be manufactured by an injection molding process using a hard plastic material, such as nylon, recycled PEP, or preferably a high density polyethylene (HDPE) or similar material.

The base 56 receives an open end 80 of the corrugated body 52 that is formed from a blank of sheet-like material. In a preferred embodiment, the sheet-like material is corrugated paperboard. In the illustrated embodiment, the corrugated paperboard body 52 includes four main panels 82, 84, 86 and 88 foldably connected along score lines to form the four walls of the corrugated body. A manufacturer's joint (not illustrated) is foldably connected to one of the main panels. The function of the joints is well known to those skilled in the art for connecting the longitudinal ends of the paperboard blank together when forming the body 52. In the illustrated embodiment, a series of four top flaps generally designated 89 are foldably connected to the main panels 82, 84, 86 and 88 for closing the open top of the corrugated body 52, as discussed below.

The end panels 84 and 88 are each provided with a pair of vertical corner reinforcement cleats 90. The vertical reinforcement cleats 90 are made of wood or other material, such as a plastic wood or fibrous material, of sufficient strength and stiffness to support a vertical stacking or top load force. The reinforcement cleats 90 extend substantially the height of their respective panel 84 and 88. A lowermost edge of the vertical reinforcement 90 sits near the bottom edge of the respective panel 84 and 88. In a preferred embodiment, the lower end of each vertical reinforcement 90 is beveled as generally indicated at 92 to matingly contact the top plate 12 of the corner socket 10 attached to the cross member 64 or 68 of the base 56. The bevel is preferably about 24°. The upper end 93 is also beveled to matingly engage the top plate 12 of the corner socket 10 attached to a runner of the top frame 54, as discussed below.

The panels 82 and 86 are each provided with a vertical reinforcement cleat 94 which is made of the same materials as the vertical reinforcement 90. The reinforcement cleat 94 extends substantially the height of its respective panel 82 and 86. In a preferred embodiment, the ends of the vertical reinforcement cleats 94 are each cut for a tenon 95, which are received by the cavity 48 of the center socket 40 when the corrugated body 52 is positioned on the base 56 and the top frame 54 is positioned on the corrugated body 52, as discussed below. In an alternate embodiment, not illustrated, the center socket 40 has a U-shaped top skirt, with the closed end of the U extending upwardly from the inside edge of the top plate 42. The top plate 42 in this embodiment could be angled downwardly from the outside edge 46 to the inside edge. The cleats 94 would have a bevel end instead of the tenon to matingly engage the center sockets.

The top frame 54 in the illustrated embodiment consists of two longitudinal runners 100 and 102 that run lengthwise of the corrugated body 52. Three cross pieces 104, 106 and 108 are secured to the top of the lengthwise runners 100 and 102. The elements 100–108 are typically made of wood and may be secured in this arrangement by nails, staples or other suitable connectors. The top frame 54 is dimensioned to sit in the uppermost portion of the corrugated paperboard body 52 on the upper ends of the vertical reinforcement cleats 90 and 94. One of the corner sockets 10 is attached to each of the longitudinal ends of the runners 100 and 102, as discussed above, and one of the center sockets 40 is attached medial the ends to the bottom surface of the runners 100 and 102 in alignment with the vertical cleats 94, for mating engagement with the upper ends of the cleats 90 and 94.

In the practice of the present invention, the blank of corrugated paperboard for the container body 52 is laid flat. The vertical reinforcement cleats 90 are fully glued and stapled to the end panels 84 and 88. A preferred adhesive is polyvinyl alcohol (PVA) and any suitable adhesive may be used. The preferred staples are three-quarter inch to one inch crown and have a leg length equal to approximately the thickness of the vertical reinforcement cleats 90 plus the thickness of the blank of corrugated paperboard for the container body 52. It is furthermore preferred that the staples be spaced-apart a distance of approximately four inches and angled at forty-five degrees to achieve maximum contact of the corrugated paperboard panel 84 and 88 to its respective vertical reinforcement 90. In a similar manner, the vertical center reinforcements 94 are glued and stapled to their respective side panels 82 and 86. The center reinforcements 94 are positioned in alignment with the center cross member 66 on the pallet 56.

After the corrugated paperboard body 52 is formed, it is then placed over the base 56 to which the article to be packaged is attached. Each of the beveled lower ends 92 of the corner cleats 90 are wedgedly received on the top plate 12 and against the top skirt 22 of the respective corner socket 10 which sockets are mounted at the longitudinal ends of the members 64 and 68 of the base 56. In the illustrated embodiment, the bevel angle at the lower end 92 of the cleat 90 mates with the bevel angle of the top plate 12 of the corner socket 10. The top skirt 22 prevents the respective corner reinforcement 90 from moving inwardly laterally or longitudinally under the horizontal pressure of the clamp truck and thereby off of the corner socket 10. Further, the respective wall 84 or 88 for the vertical reinforcement cleat 90 cooperates with the corner socket 10 to prevent the corner reinforcement cleat from moving out of the corner socket. At the same time, the tenon 95 at the lower end of the center reinforcement cleat 94 enters the cavity 48 of the center socket 40 which is attached to an upper surface of the center cross member 66. An underside surface of the lower end of the center cleat 94 adjacent the tenon 95 rests on the upper surface of the top plate 42. The cavity 48 prevents the center reinforcements 94 from moving laterally and longitudinally from the center socket 40 during shipping and handling.

The top frame 54 is then positioned on the upper ends of the corner reinforcement cleats 90 and the center reinforcements 94 to fit the upper ends thereof in the corner sockets 10 and center sockets 40 attached to a bottom surface of the runners 100 and 102. The flaps 89 are folded on the scores to close the top of the corrugated body 52.

It will be appreciated that the above-described invention provides a significant advantage over prior art containers. The corner sockets 10 are rapidly and easily positioned on the base 56 and the top frame 54 for securing thereto with staples. The bottom skirt 30 on the outside edges 18 and 20 of the top plate 12 abuts against the outside faces of the cross member 64 and 68 in the base 56 and the outside faces of the runners 100 and 102. The corner sockets 10 prevent longitudinal and lateral movement of the corner reinforcement cleats 90 during handling of the container. The top skirt 22 on the inside edges 14 and 16 of the top plate 12 prevents the corner reinforcement 90 from moving out of the sockets 10. The wedge-shaped flanges 24 provide lateral support to the back wall 28 of the top skirt 22. Similarly, the center socket 40 is quickly and easily positioned on the center cross member 66 and the runners 100 and 102 in alignment with the vertical cleats 94 and secured thereto with staples. The depending skirt 46 abuts the outside face of the cross member 66 and the runners 100 and 102 for positioning the center socket 40. The tenon 95 in the ends of the center reinforcement cleat 94 are received in the cavity 48 of the center sockets 40. Each of the tenons are accordingly wrapped by one of the sockets 40 which prevent the end of the center cleats 94 from moving laterally or longitudinally out of the sockets 40 during handling of the container.

The principles, preferred embodiments and modes of operation of the present invention have been described in the foregoing specification. The invention is not to be construed as limited to the particular forms disclosed, because these are regarded as illustrative rather than restrictive. Moreover, variations and changes may be made by those skilled in the art without departing from the spirit of the invention as set forth by the following claims.

What is claimed is:

1. A socket for attachment to a base that matingly engages a corrugated paperboard body having at least one vertical cleat attached to a wall of the corrugated paperboard body, comprising:

a unitary body having a top plate for receiving an end of the vertical cleat;

a bottom skirt extending downwardly along an outside end edge and a first side edge of the top plate for abutting against a pair of side faces of a member of the base;

a top skirt extending upwardly along an inside end edge and a second side edge of the top plate; and a plurality of spaced-apart flanges extending outwardly from a back side of the top skirt for lateral support of the top skirt, whereby the socket receives and holds the end of the vertical cleat when the corrugated paperboard body is positioned on the base.

2. The socket as recited in claim 1, wherein the flanges are wedge-shaped with a wider base at a bottom portion of the top skirt.

3. The socket as recited in claim 1, wherein the top plate is rectangular; and wherein the bottom skirt and the top skirt are L-shaped.

4. The socket as recited in claim 1, wherein the top plate angles downwardly from the first side edge to the second side edge.

5. A socket for attachment to a base that matingly engages a corrugated paperboard body having at least one vertical cleat attached to a wall of the corrugated paperboard body, comprising:

a unitary body having a top plate that angles downwardly from a first side edge to a second side edge for receiving an end of the vertical cleat;

a bottom skirt extending downwardly along an outside end edge and the first side edge of the top plate for abutting against a pair of side faces of a member of the base; and a top skirt extending upwardly along an inside end edge and the second side edge of the top plate, whereby the socket receives and holds the end of the vertical cleat when the corrugated paperboard body is positioned on the base.

6. A wood-cleated reinforced corrugated paperboard container, comprising:

a corrugated paperboard body having two opposing end walls and two opposing side walls;

a pair of first cleats attached vertically to each of the opposing end walls, each of said first cleats having a beveled lower end;

a base for mating connection with the corrugated paperboard body comprising a pair of spaced-apart runners and at least a pair of cross members, one of the cross members attached between the runners at each respective longitudinal end of the runners; and four corner sockets, each of which is attached at a longitudinal end of one of the cross members, each corner socket comprising:

a unitary body having a top plate for receiving the beveled end of one of the first cleats;

a bottom skirt extending downwardly along an outside end edge and a first side edge of the top plate and abutting against a pair of side faces of the respective cross member; and a top skirt extending upwardly along an inside and edge and a second side edge of the top plate, whereby the corner sockets receive the lower ends of the first cleats when the corrugated paperboard body is positioned on the base.

7. The container as recited in claim 6, further comprising:

two second cleats, each of which has a tenon at a lower end and is attached vertically to one of the opposing side walls;

a third cross member attached between the runners; and two side sockets, each side socket attached to a longitudinal end of the third cross member for receiving the tenon on the respective one of the second cleats, each side socket comprising:

a unitary body having a cavity for receiving the tenon; and a bottom skirt extending downwardly along an outside edge of the unitary body and abutting against an end face of the third cross member.

8. The container as recited in claim 6, further comprising a plurality of spaced-apart wedge-shaped flanges extending outwardly from a back side of the top skirt, for lateral support thereof.

* * * * *